US007727388B1

(12) United States Patent
Houck

(10) Patent No.: US 7,727,388 B1
(45) Date of Patent: Jun. 1, 2010

(54) SEPTIC TANK AND DRAINFIELD PRODUCTS, SYSTEMS AND METHODS

(76) Inventor: Randall J. Houck, 705 Standish Dr., St. Augustine, FL (US) 32086

( * ) Notice: Subject to any disclaimer, the term of this patent is extended or adjusted under 35 U.S.C. 154(b) by 0 days.

(21) Appl. No.: 11/433,794

(22) Filed: May 11, 2006

Related U.S. Application Data

(63) Continuation-in-part of application No. 10/994,809, filed on Nov. 22, 2004, now abandoned, and a continuation-in-part of application No. 10/702,857, filed on Nov. 6, 2003, now abandoned.

(60) Provisional application No. 60/714,473, filed on Sep. 6, 2005.

(51) Int. Cl.
*C02F 9/00* (2006.01)

(52) U.S. Cl. ..... 210/170.08

(58) Field of Classification Search ..... 210/170.08, 210/150, 151
See application file for complete search history.

(56) References Cited

U.S. PATENT DOCUMENTS 4,100,073 A * 7/1978 Hopcroft ..... 210/532.1
4,895,645 A * 1/1990 Zorich, Jr. ..... 210/98
4,971,690 A 11/1990 Justice ..... 210/170
5,564,857 A * 10/1996 Schluter ..... 405/36
5,676,828 A * 10/1997 Kallenbach et al. ..... 210/117
5,762,784 A * 6/1998 Jowett ..... 210/150
5,788,409 A * 8/1998 Johnson ..... 405/43
5,989,416 A * 11/1999 Gorton ..... 210/151
6,153,094 A * 11/2000 Jowett et al. ..... 210/151
6,187,183 B1 2/2001 Weaver et al. ..... 210/150
6,277,280 B1 * 8/2001 Houck ..... 210/616
6,746,179 B1 * 6/2004 Kerkhoff ..... 405/45

FOREIGN PATENT DOCUMENTS

GB 2263522 A * 7/1993

* cited by examiner

*Primary Examiner*—Sunil Singh
(74) *Attorney, Agent, or Firm*—Allen Dyer Doppelt Milbrath & Gilchrist

(57) ABSTRACT

An underground system for distributing and filtering post-septic effluent includes an underground watertight basin containing a filter and conduit connecting a septic tank with the watertight basin for transporting the post-septic effluent into the watertight basin. A discharge pipe connected to the watertight basin transports filtered effluent from the watertight basin into a drainfield reserve for introduction into surrounding natural ground soil.

17 Claims, 8 Drawing Sheets

SEPTIC TANK AND DRAINFIELD PRODUCTS, SYSTEMS AND METHODS

CROSS-REFERENCE TO RELATED APPLICATIONS

This application claims priority to Provisional Application Ser. No. 60/714,473 for "Drainage System and Method Using Mount Reduction Techniques" filed on Sep. 6, 2005 and is a continuation-in part of both patent application Ser. No. 10/702,857 filed on Nov. 6, 2003 and application Ser. No. 10/994,809 filed on Nov. 22, 2004 both now abandoned.

BACKGROUND OF THE INVENTION

1. Field of the Invention

The present invention relates to underground drainfield systems and methods for treating, filtering, cleaning, discharging and recycling septic tank effluent or drainfield water in difficult soil conditions that historically have required an above ground mound system or an intermittent sand filter.

2. The Prior Art

In the United States, a growing number of households rely upon a septic system rather than centralized wastewater treatment facilities. In fact, approximately one fourth of households in the United States use a septic system to treat, filter, clean and disburse wastewater. A typical septic system consists of a septic tank, a distribution/filtration box and some form of an underground disposal field. Several types of underground disposal fields have been developed and are known in the art. The most common type is a drainfield, also known as a leach field or absorption field. There have been several variations of drainfields, including mound systems, sand filters and dig outs.

Once sewage undergoes treatment in a septic tank, the resulting effluent is transported to the drainfield. This is accomplished by either gravity or through a mechanical pump, with the goal of uniformly discharging effluent below ground into the soil for final treatment and disposal. Another goal of the drainfield is to naturally filter the post-septic tank effluent to remove any remaining pathogens, bacteria, or biomass prior to flowing into the ground water. Sizing of a drainfield depends upon several factors including the area of the property, the number of individuals in the household, water usage habits of the household, on-site soil conditions, and government regulations. One typical form of a drainfield comprises a collection of multiple parallel-perforated pipes connected by one or more distribution pipes that allow distribution of effluent into the surrounding ground soil for filtration.

Historically, construction of a drainfield has been expensive, time consuming and inconvenient. Construction usually begins with the excavation of a large rectangular cross section of land by digging multiple trenches at least three feet deep to lay the necessary perforated pipes. These trenches are usually less than 100 feet long, and dug to create an essentially flat bottom. In one prior art drainfield construction, each trench is first filled with a layer of gravel. Next, a perforated pipe is placed in the trench, with an additional six-inch layer of gravel added to surround the perforated pipe. A geotextile fabric or a similar product is placed over the approximately two feet of gravel. Finally, a covering layer of backfill soil is added. This entire process requires transport of large amounts of gravel, backfill soil and piping from a distribution center to the drainfield site. The steps of digging trenches, creating a network of piping and laying different layers of filtering media requires specialized equipment, multiple experienced workers, time, and large amounts of natural resources.

In many areas of the country, unique soil conditions require a modified drainfield known as a mound or raised drainfield. In areas with high groundwater, shallow soil over impermeable soil or slowly permeable soil, a mound must be created above ground to allow proper distribution and filtration of post-septic effluent. However, above ground mounds often require a mechanical pump to raise effluent from the septic tank above ground to the mound. Second, mounds require transport of additional natural resources to the site. Third, mounds are typically unsightly and greatly reduce the use of the land. Lastly, mounds require a relatively larger area than conventional drainfields and also require routine monitoring and maintenance.

For areas with high ground water or impervious soil, one alternative for a mound or raised drainfield is an intermittent sand filter. An intermittent sand filter is a water impermeable basin placed in the ground containing a network of perforated pipes located in a sand bed. The water impermeable basin is first filled with a layer of aggregate, most commonly pea gravel. Next, a second layer of medium grade clean sand is added to the basin to create the sand bed. A network of perforated pipes is placed on top of the sand bed. A second layer of aggregate is then added to the basin. A larger perforated outflow pipe is typically placed within the basin for collection of filtered effluent that then enters the drainfield.

Although intermittent sand filters reduce the need for a mound, improve the appearance of the underground disposal field and allow for better use of the ground, there are several disadvantages. First, intermittent sand filters require transporting large volumes of heavy sand to the drainfield site, which can be very costly. Second, intermittent sand filters require very large cross sections to be effective. For example, a typical two-bedroom home would require a sand filter nineteen by nineteen feet in cross section. Thus, these systems can only work with large acreage households. Third, most intermittent sand filters require a mechanical pump, which results in greater energy and maintenance costs.

Apart from intermittent sand filters and mound systems, a third type of drainfield called a "dig out" has also been used in the art. With a dig out, a large cross sectional area of the soil near the septic tank is excavated to remove poor soil. Good quality soil is then transported to the site through one or more commercial vehicles. The good soil is then evenly deposited within the excavated area. A network of perforated piping is assembled and placed on top of the newly deposited soil, which is connected to either a distribution box or directly to the septic tank. Backfill soil is then added over the network of perforated piping. While this method of creating a drainfield has some benefits with respect to an intermittent sand filter, the overall costs, manpower and natural resources required to create a dig out system are significantly greater.

There exists a need for an alternative to intermittent sand filters and mound drainfields for efficient treatment, filtration, and distribution of effluent. In addition, there is a need for a filter media that is light weight, portable, inexpensive and allows for increased filtration to decrease the cross sectional size of these systems. Finally, there is a need for such systems to be modular for easy transport to the drainfield site, to allow improved fabrication of these systems, for further reduction in overall costs.

SUMMARY OF THE INVENTION

This invention is directed to a system and method for treating, filtering, disbursing, discharging and recycling effluent, or any form of wastewater, in difficult soil conditions that historically required either an unpleasant mound or an intermittent sand filter.

The present invention comprises a filtration system that includes a sub-system referred to herein as the Mound Reduction Filter Unit ("the MRFU") and the associated method as the "Mound Reduction Filter Method" ("the MRFM"). In one embodiment, the MRFU is located downstream from a septic tank and is connected to the tank either directly or through an intermediate distribution/filtration sub-system. Aided by gravity, post-septic effluent leaves the septic tank and preferably travels to a distribution sub-system where it is filtered for any remaining sludge, particulates, residue or biomass. Within this post-filtration chamber, effluent is treated for removal of bacteria and pathogens. The effluent then leaves the distribution unit through a second pipeline into the MRFU. Within the MRFU, one or more perforated pipes uniformly distributes the effluent through the MRFU for additional treatment and filtration of any remaining pathogens, bacteria or human waste. In a preferred embodiment, the cleansed effluent then leaves the MRFU through either a slotted linear grate or a series of screened portals into a discharge pipe and then flows to a drainfield reserve.

The MRFU comprises a watertight basin that is preferably rectangular, but can be of any shape that provides a sufficient volume of effluent filtration and treatment. The MRFU is made of any resilient material, preferably a lightweight plastic and comprises a bottom, connected sidewalls, and a removable top. The removable top preferably includes a geotextile fabric. Connected at each corner of the bottom side of the removable top are metallic members to permit the MRFU to be opened for maintenance or inspection.

The MRFU is filled with filter media that can be any combination of aggregate, soil, sand, gravel, rock, beaded material, or the like. The preferred filter media is variable sized expanded polystyrene (E.P.S.) beads having a diameter on the order of one-eighth inch or less.

The MRFU is sized to allow easy transport to a drainfield site via a commercial vehicle. Using a modular construction, several MRFUs can be attached together in parallel or in series depending upon the size and site conditions of the installation.

A drainage unit it positioned below the MRFU and functions to transport post-MRFU filtered effluent to the drainfield reserve. The drainage unit comprises two components, a discharge pipe and a culvert. Preferably, the discharge pipe is fabricated from high-density polyethylene (H.D.P.E) or a similar material.

Several forms of the culvert are suitable; for example, a rectangular slotted culvert that connects through a slot in the MRFU can be used. Such an arrangement is taught in copending application Ser. No. 10/702,857. The slotted portion prevents filter media from escaping the MRFU during effluent transport through the discharge pipe and can be of any known type of grate or a mesh. The top side of the slotted culvert is fitted with the bottom of the MRFU, allowing filtered effluent to flow downward into the discharge pipe.

In a second embodiment, one or more grated portals form a linear relationship along the top shaft of the discharge pipe and permit passage of the filtered effluent from the bottom of the MRFU into the discharge pipe while retaining the filter media in the MRFU. These portals are preferably positioned equidistantly along the shaft and in one example are attached on top of a single discharge pipe. Alternatively, a series of component members are attached to linear tubing portions, allowing the use of standard industry H.D.P.E. tubing. These members are either a ninety degree elbow (the initial portion) or a "tee" shaped portion (along the shaft) above which is a grated portal structure. The interface between the drainage unit and MRFU is preferably watertight.

From this grated culvert or series of portals, effluent flows downward from the MRFU into the discharge pipe. In another arrangement, the discharge pipe contains a filter media, such as expanded polystyrene (E.P.S.) beads, allowing additional treatment and filtration of effluent. The discharge pipe underneath the MRFU is preferably linear and longer than the total length of the MRFU with a portion of the discharge pipe extending beyond the MRFU in a direction opposite the inlet to the MRFU. The extending portion of the discharge pipe preferably comprises two generally ninety-degree turns, creating an "S"-shaped flow path. To ensure proper flow of effluent via gravity, the end of the "S" shaped portion of the discharge pipe is below the inlet entering the MRFU. This shape should allow flow from the discharge pipe into the drainfield reserve, without need for a mechanical pump.

The end portion of the "S" shaped portion of the discharge pipe is connected to one or more reservoir retention chambers, forming a drainfield reserve. These retention chambers are preferably elongated mesh tubes filled with a filter media such as expanded polystyrene aggregate (E.P.S.). A perforated pipe can be placed within the elongated mesh tubes to permit flow to be directed from the discharge pipe throughout the filter media. These elongated mesh tubes are positioned in a generally downward direction from the MRFU allowing gravity to transport effluent along the drainfield reserve. From the drainfield reserve, the effluent then enters the ground water.

BRIEF DESCRIPTION OF THE DRAWINGS

A preferred embodiment of the invention, as well as alternative embodiments, are described by way of example with reference to the accompanying drawings in which.

DETAILED DESCRIPTION

Figure 1:
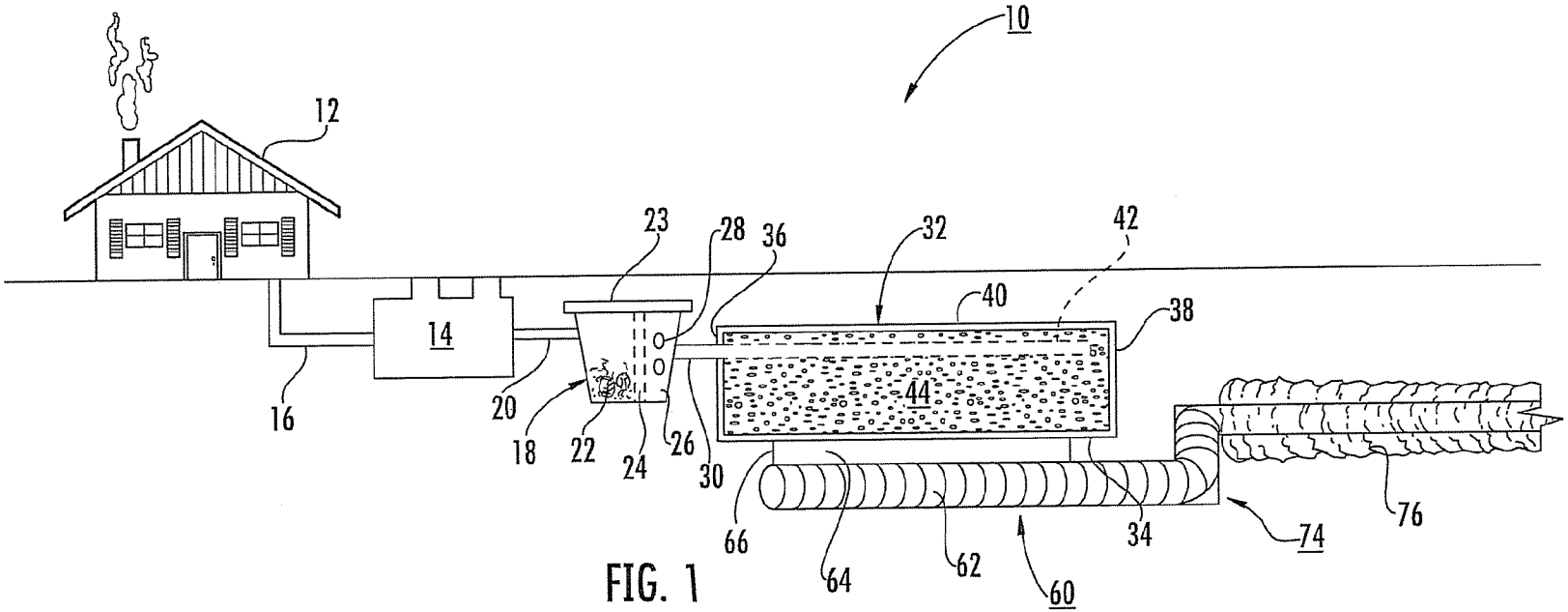
FIG. 1 is a cross sectional schematic view of a septic system according to this invention.

The present invention will now be described with reference to the accompanying drawings, in which preferred embodiments of the invention are shown. This invention may, however, be embodied in many different forms and should not be construed as limited to the illustrated embodiments shown in the drawings and described in this specification. Rather, these illustrated embodiments are intended to convey the scope of the invention to those skilled in the art.

The invention set forth herein provides improved filtration for any effluent or drainage setting, and is not limited to distributing and filtering post-septic tank effluent. For example, the invention can be applied to watershed runoff, collection of rainwater along roads and use in small commercial sites for non-toxic water disposal. Other related uses will be clear to those skilled in the art. However, FIGS. 1 through 8 illustrate the present invention embodied in a septic system for filtering sewage from a septic tank and, for purposes of illustration includes (i) a combination distribution and filtration sub-system for removing biomass and bacteria, (ii) a sub-system that functions as an alternative to drainfields described herein as a Mount Reduction Filter Unit ("MRFU"), (iii) a drainage unit for collection and transport of post-MRFU effluent, and (iv) a drainfield reserve for final distribution of cleansed effluent into the soil and ground water.

FIGS. 1, 2 4 and 5 illustrate a preferred embodiment 10 of a filtration system according to this invention. Wastewater flows from a household 12 to a conventional septic tank 14 through a distribution pipe 16 below ground. Within the septic tank 14, the suspended solids within the wastewater separate according to their density, with heavier solids resting at the tank bottom and lighter solids floating on the surface. Cultures of bacteria are deposited into the septic tank 14 that decompose the solids and other suspensions. Wastewater is usually deposited from the household 12 into the septic tank 14 in periodic intervals throughout the day, most typically in the morning, in the late afternoon and in the evening. Within the period of wastewater deposits, there is a retention time sufficient to allow the cultures to decompose the solids and other suspensions. After this retention time, a subsequent wastewater deposit pushes post-septic effluent from the septic tank 14 into a distribution/filtration sub-system 18 through a post-septic distribution conduit 20.

The distribution/filtration sub-system 18 is preferably rectangular, but could be of any shape known in the art that allows for proper filtration and distribution of effluent. The sub-system 18 preferably comprises three sections: a pre-filtration chamber 22, a filter 24, and a post-filtration chamber 26. Preferably contained within the post-filtration chamber 26 are chlorine tablets 28.

The distribution/filtration sub-system 18 may be fabricated in accordance with the teachings of U.S. Pat. No. 6,277,280, the disclosure of which is incorporated herein by reference.

Effluent into the pre-filtration chamber 22 is then separated by the filter 24. The filter can be a screen, multiple slits throughout the surface of a plane, a perforated grate or a resilient mesh bag filled with expanded polystyrene (E.P.S). Any residual sludge remains in the pre-filtration chamber 22. The post-filtered effluent then contacts the chlorine tablets 28 for removal of bacteria and further decomposition of any remaining suspensions. During retention times when there is no incoming wastewater into the system, the concentration gradient between the super-chlorinated post-filtered effluent in chamber 26 and the incoming pre-filtered septic effluent causes dissolved chlorine to move across the filter 24 and into the pre-filtration chamber 22. This further destroys remaining bacteria in the sludge and supports further decomposition of remaining biomass in the sub-system 18. In the event that the filter 24 becomes clogged due to accumulated sludge, the top of the sub-system 18 can be removed, and the filter can be easily replaced or the sludge can be pumped from chamber 22.

The effluent out of sub-system 18 flows through a post-filtration conduit 30 into a Mount Reduction Filter Unit (MRFU) sub-system, referred to generally with reference numeral 32. The MRFU 32 is a basin having a bottom 34, four connected walls including end walls 36, 38, side walls 37, 39 and a removable top 40. The removable top 40 may include means allowing the MRFU 32 to be opened for maintenance or inspection. The conduit 30 is a distance below distribution conduit 20, allowing effluent to flow through the system 10 without the need for a pump.

Effluent from the sub-system 18 flows into the MRFU 32 through an effluent distribution pipe 42. The distribution pipe 42 can be a single perforated pipe or a network of perforated pipes. Within the MRFU 32, filter media 44 permits further cleansing of post-filtered effluent from the sub-system 18. Along the bottom 34 of the MRFU 32 there is one or more slits or openings to allow post-MRFU cleansed effluent to exit the MRFU 34 via a drainage unit as described in greater detail below.

Figure 2:
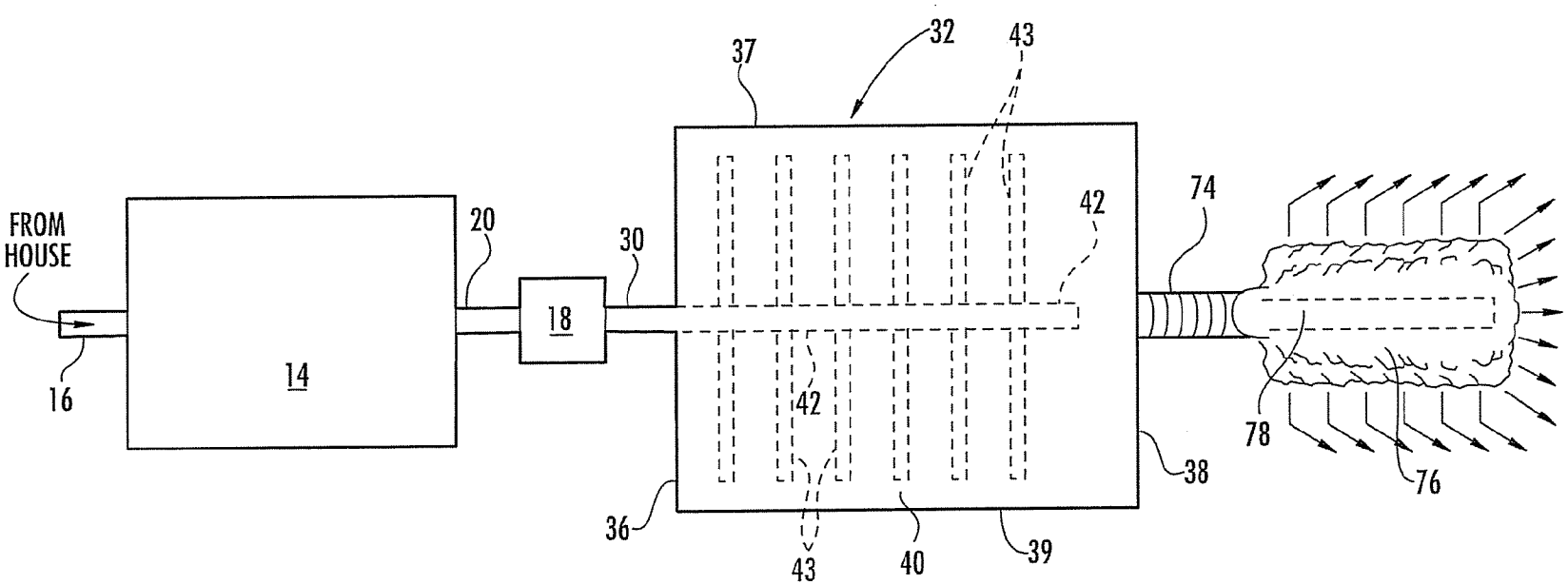
FIG. 2 is a top schematic view of the septic system shown in FIG. 1.
Figure 3:
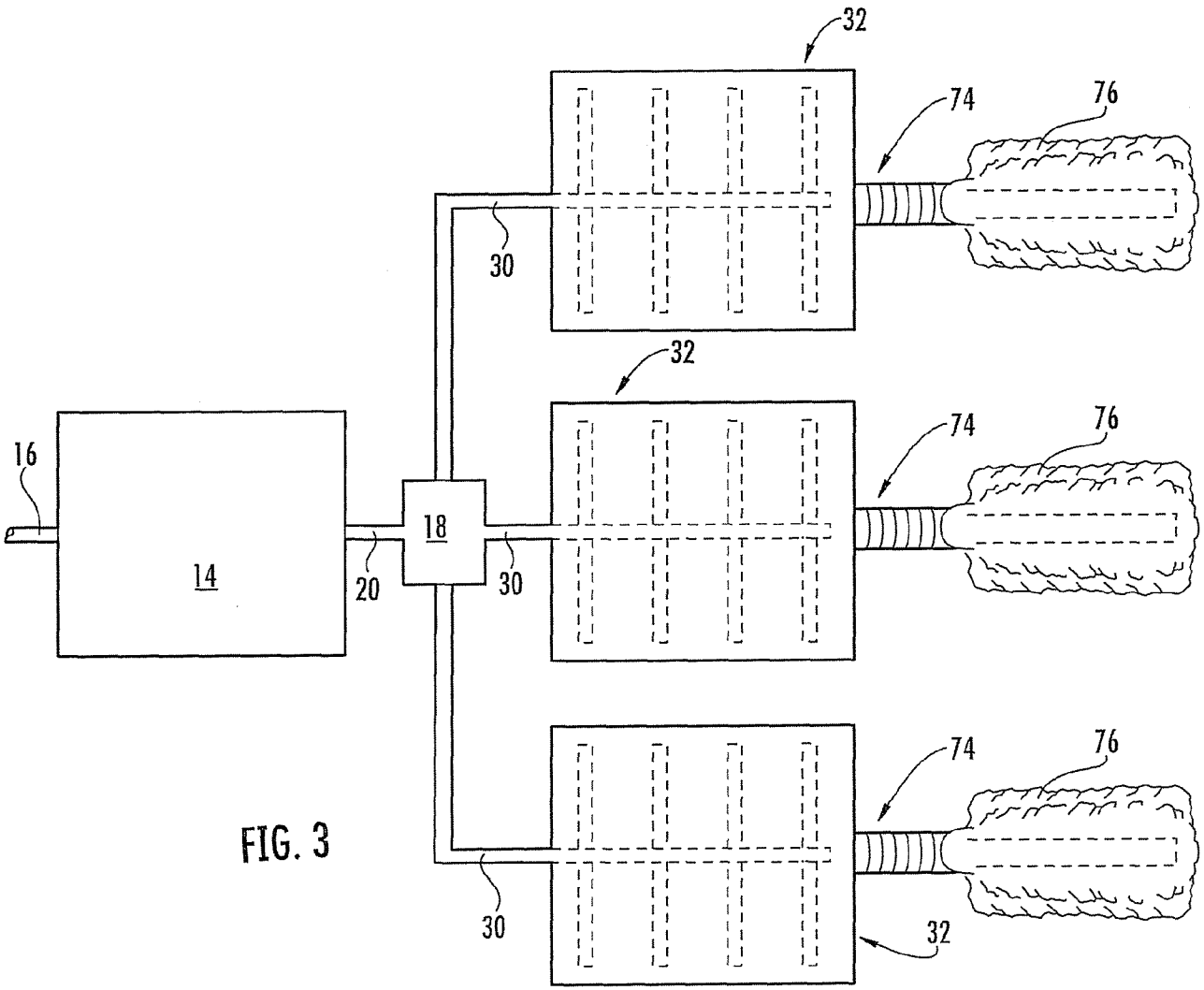
FIG. 3 is a top schematic view showing a septic system that includes three parallel Mound Reduction Filter Units (MRFUs), with accompanying drainage units and drainfield reserves.

FIGS. 2 through 6 better illustrate the MRFU 32, its internal components and potential arrangements of multiple modular units. The MRFU 32 is preferably rectangular, but can be of any size or shape that provides a sufficient volume to permit complete cleansing and filtration of the effluent from the sub-system 18. While the sizing of the MRFU 32 can vary, the preferred shape is sufficient to permit the unit to be transported via a flat bed truck or similar commercial vehicle, allowing for uniform fabrication of the MRFU 32 to reduce construction and installation costs. The MRFU 32 can be constructed of any material that permits the unit to be waterproof. Preferred materials for the MRFU 32 include plastic, lined concrete, corrugated material, PVC or any other known water impervious material. Depending upon the size of the household or the household's generation of wastewater, more than one MRFU 32 can be used. As an example, a parallel arrangement of three units 32 is illustrated in FIG. 3. However, the invention also contemplates multiple modular units placed in series or both parallel and in series, depending upon either or both the treatment demands or acreage space constraints.

Figure 4:
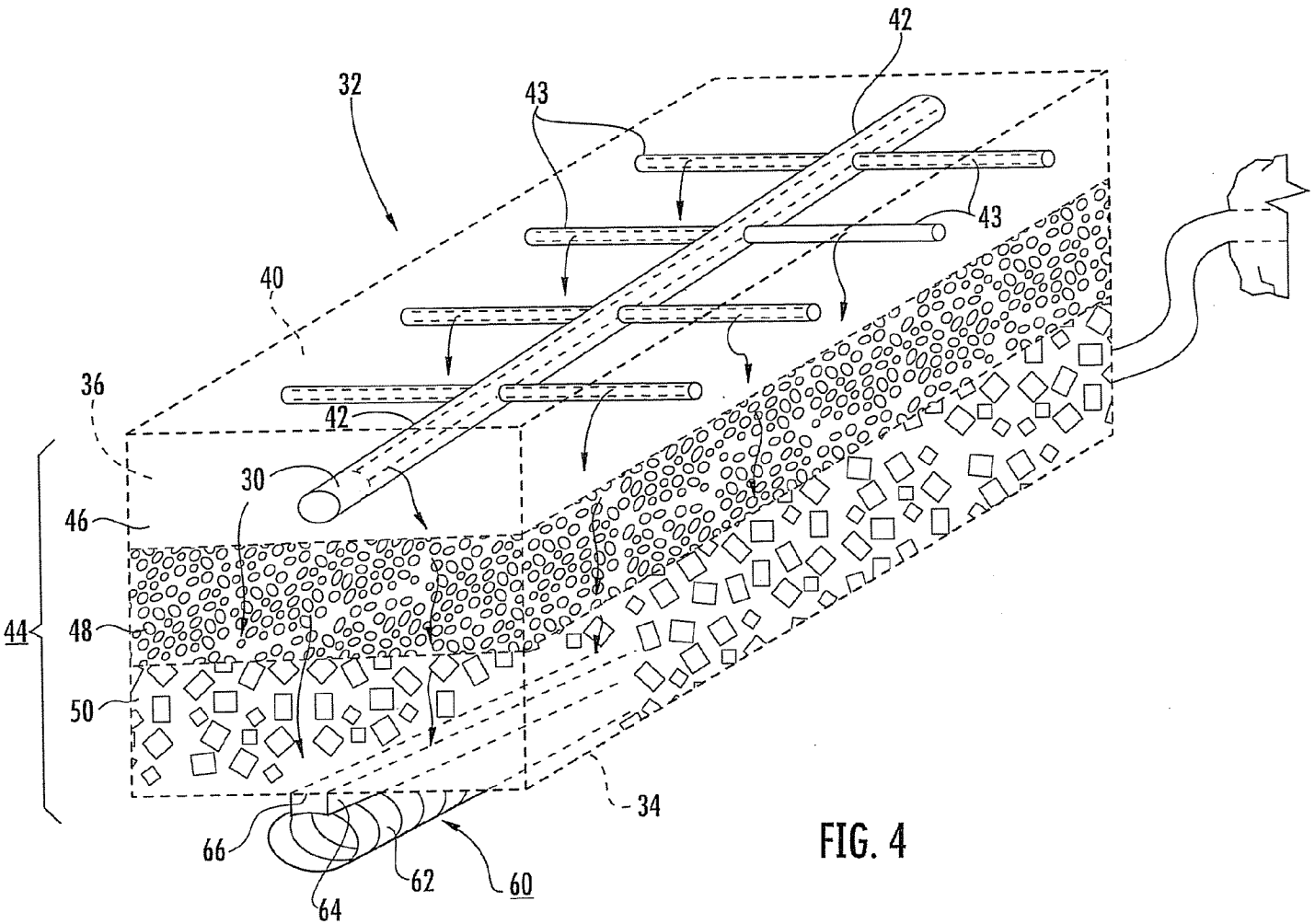
FIG. 4 is a perspective view of the Mound Reduction Filter Unit (MRFU) and drainage unit sub-systems of the present invention.

The internal construction of the MRFU unit 32 is illustrated in greater detail in FIG. 4, where the walls, top and bottom of the MRFU 32 are shown by dotted lines. The filter media 44 can be any suitable material including but not limited to sand, pea gravel, soil or rock. However, as described above, the preferred filter media 44 for the MRFU 32 is variable sized expanded polystyrene (E.P.S) beads that are one-eighth inch or less in diameter. There may be one or more different layers of filter media within the MRFU 32. By way of example, three separate layers of filter media 44 are shown in FIG. 4, including a top layer of lightweight large polymer aggregate 46, an intermediate layer of expanded polystyrene 48, and a lower layer of heavy small-sized polymer aggregate 50. One advantage of using expanded polystyrene beads 48 is that some particulates in the effluent may have a static charge.

Attention is now directed to FIGS. 1-4. Positioned through the MRFU 32, is an effluent distribution network that connects effluent flow to the MRFU 32 from either a sub-system 18 or directly from the septic tank 14. In one arrangement the effluent distribution network includes a central pipe 42 coupled with a series of evenly spaced lateral perforated pipes coupled to the central pipe 42. Other shapes and arrangements for the effluent distribution network can be envisioned by those skilled in the art. As shown by flow arrows in FIG. 4, the effluent flows into the effluent distribution network through the pipes 42, 43 and then downward throughout the filter media and into the drainage unit, referred to generally in FIG. 4 with reference numeral 60.

Figure 5:
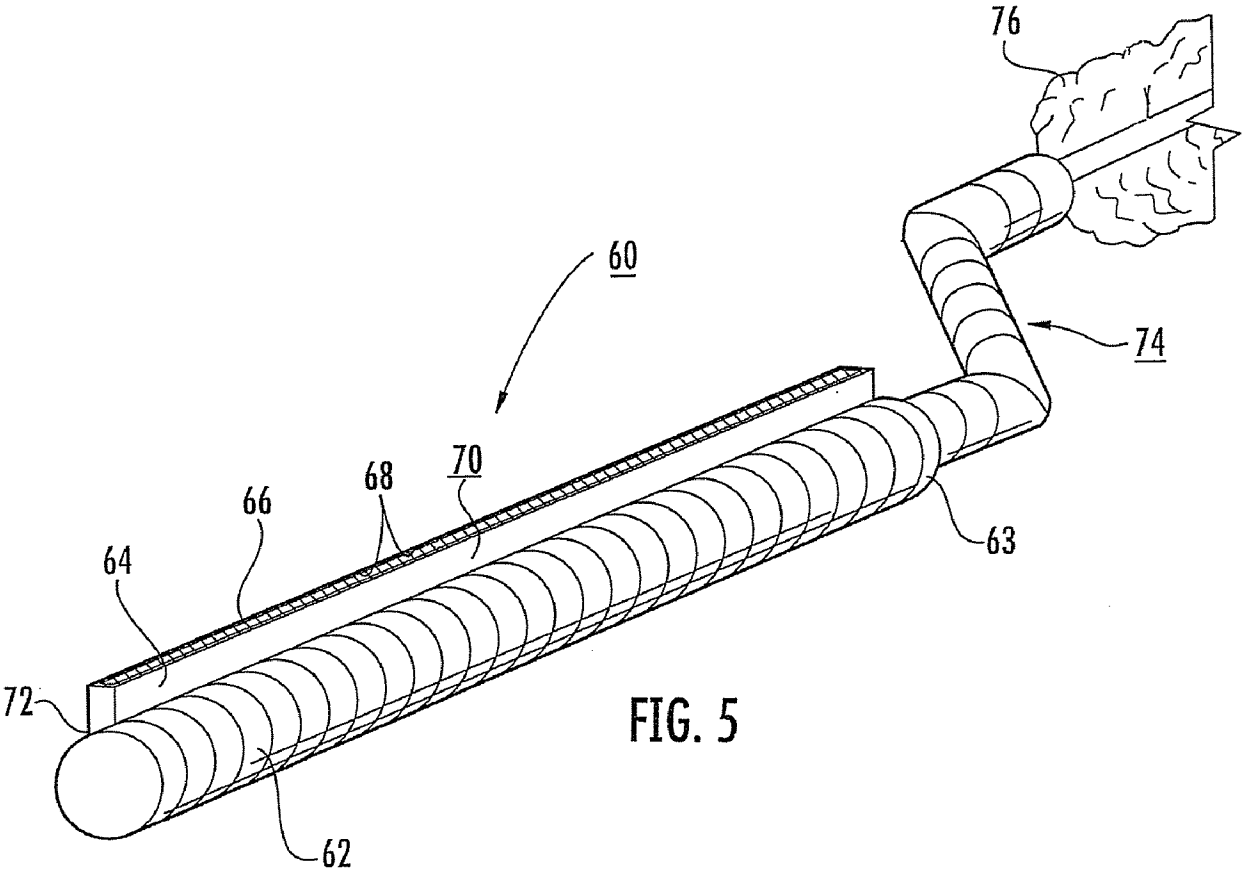
FIG. 5 is a perspective view of the drainage unit subsystem.

FIG. 5 shows one embodiment of the drainage unit 60, which includes a discharge pipe 62 and a generally rectangular grated culvert 64. The discharge pipe 62 is preferably rigid and made of high-density polyethylene (H.D.P.E.); however, alternative materials include sheet metal, corrugated material, PVC, lined concrete or any similar material known in the art. The rectangular grated culvert 64 is attached via a watertight seal 66 on top of the rigid discharge pipe 62, and functions as a drain to filter and direct the flow of effluent from the MRFU 32. The grated culvert 64 has a preferably grated or mesh top 68, four enclosing side walls 70, and an open bottom 72 that forms a watertight seal with the top of the discharge pipe 62. The grated culvert 64 is preferably made of the same material as the discharge pipe 62.

As shown in FIGS. 1, 2, and 5, an "S" shaped unit 74 located at the distal end 63 of the discharge pipe 62 is connected to one or more reservoir retention chambers 76 each of which is coupled with a drainfield reserve 78. The "S" shaped unit 74 may, for example, comprise of two generally 90 degree turns in the discharge pipe 62. The "S" shaped unit 74 is positioned below the conduit 30 to allow flow out of the discharge pipe 62 via gravity. The distal end of each "S" shaped unit 74 is then connected to at least one reservoir retention chambers 76. In a preferred embodiment, each retention chambers 76 comprises a mesh bag filled with expanded polystyrene beads. However, the material within the retention chamber 76 can be any polymer aggregate, pea gravel, rock or related material known in the art. Further, a perforated pipe can be added to the retention chamber 76 for distribution of effluent to a drainfield reserve area adjacent each retention chamber 76.

Figure 6:
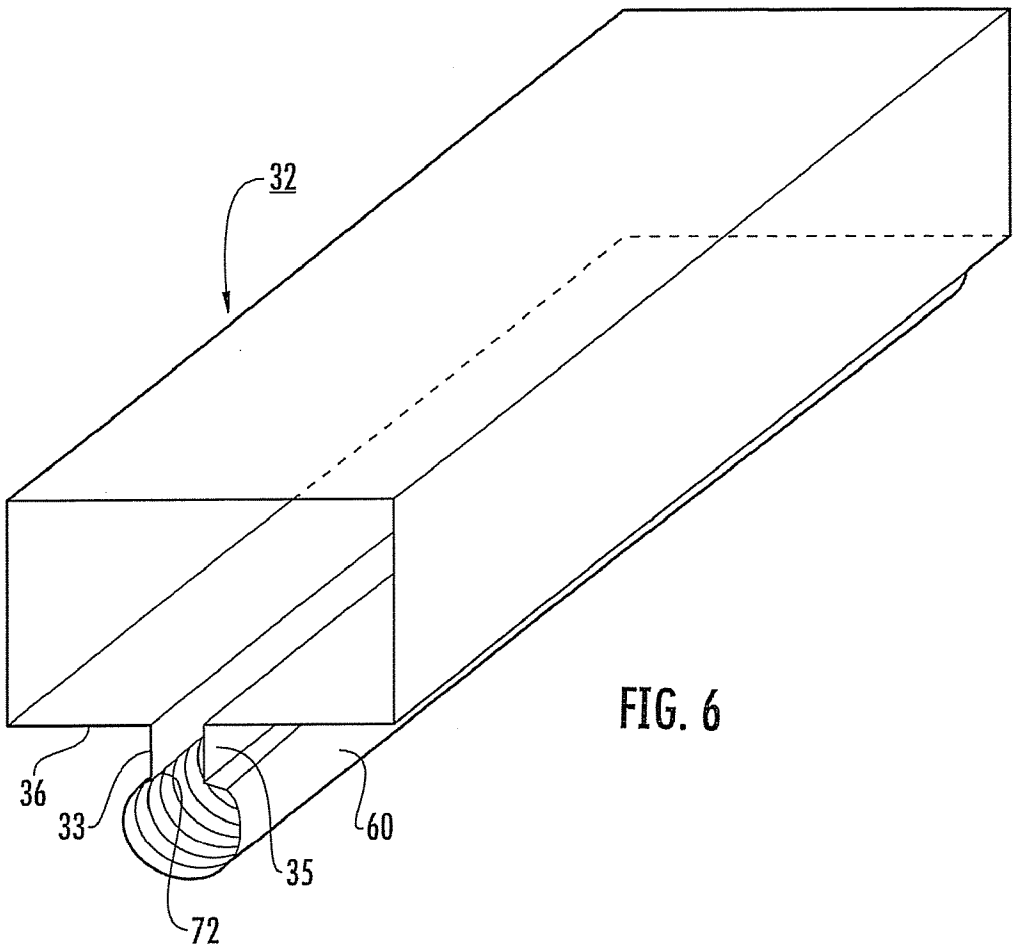
FIG. 6 is a perspective view of an alternative embodiment of the drainage unit shown in FIG. 5.

FIG. 6 illustrates an alternative embodiment for the connection between the bottom 34 of the MRFU 32 and the drainage unit 60. In this arrangement, the bottom of the MRFU 32 includes two downwardly extending sidewalls 33, 35. The sidewalls are preferably integrally formed with the MRFU 32. The sidewalls 33, 35 connect directly with opening 72 in the discharge pipe 62.

Figure 7:
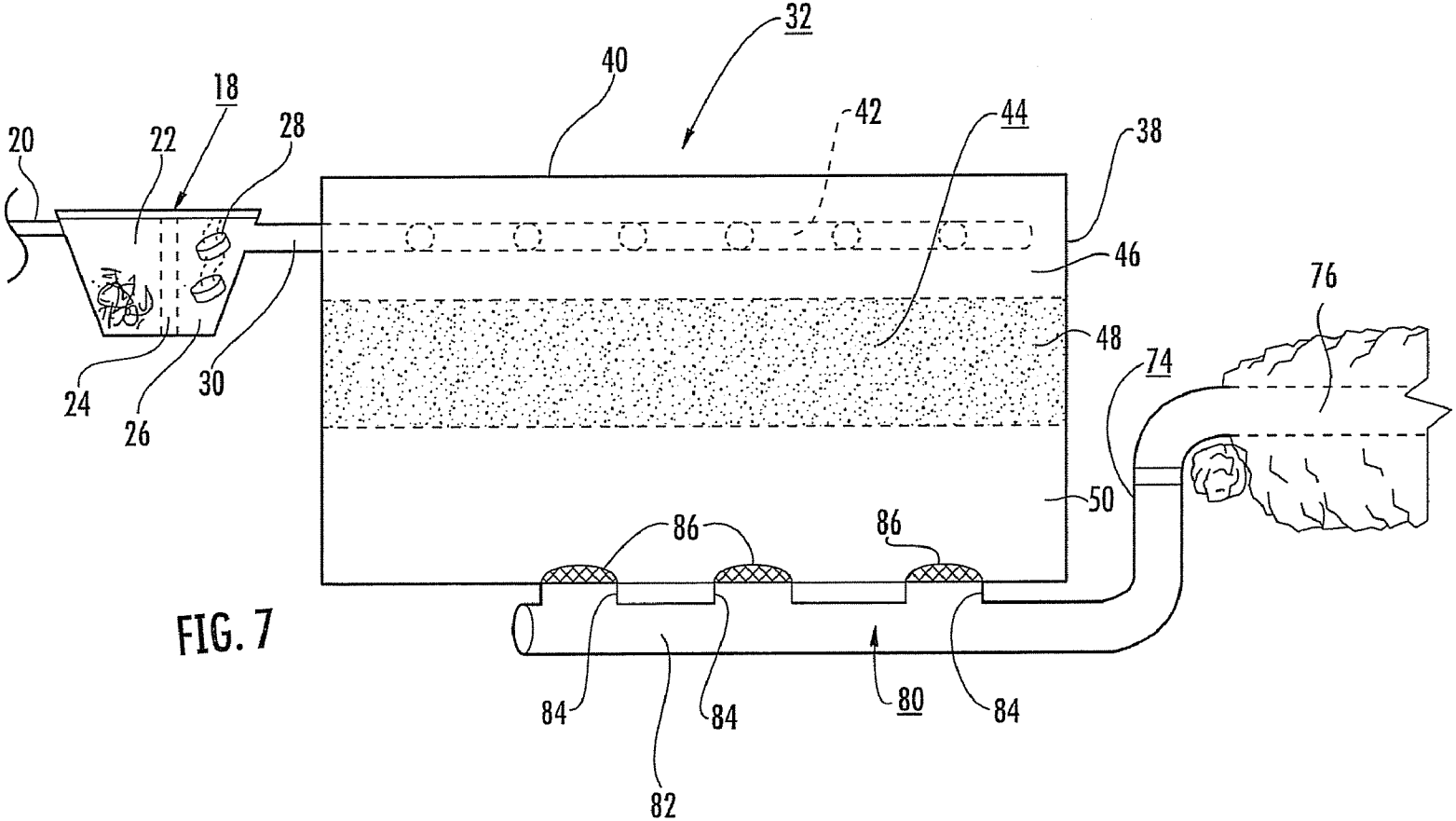
FIG. 7 and FIG. 8 are cross-sectional side views of alternative embodiments MRFU-drainage unit constructions.

FIG. 7 shows an additional embodiment for the drainage unit. In this alternative arrangement, the drainage unit 80 includes multiple passageways 84 positioned in series along the discharge pipe 82. One preferred form of such a passageway 84 or system of passages with grates 86 therein. However, one of ordinary skill in the art can envision alternative passageways 84 or shapes for such grated portals. For example, the passageways 84 could be circular, elliptical, square, or any known shape that allows a sufficient cross-sectional area and flow path for transport of effluent to enter the discharge pipe 82.

While the portals may be attached to a single length of discharge pipe as shown in FIG. 7, the drainage unit can be constructed of multiple components for assembly on-site, and to further reduce costs, by using commercially available H.D.P.E corrugated tubing.

Figure 8:
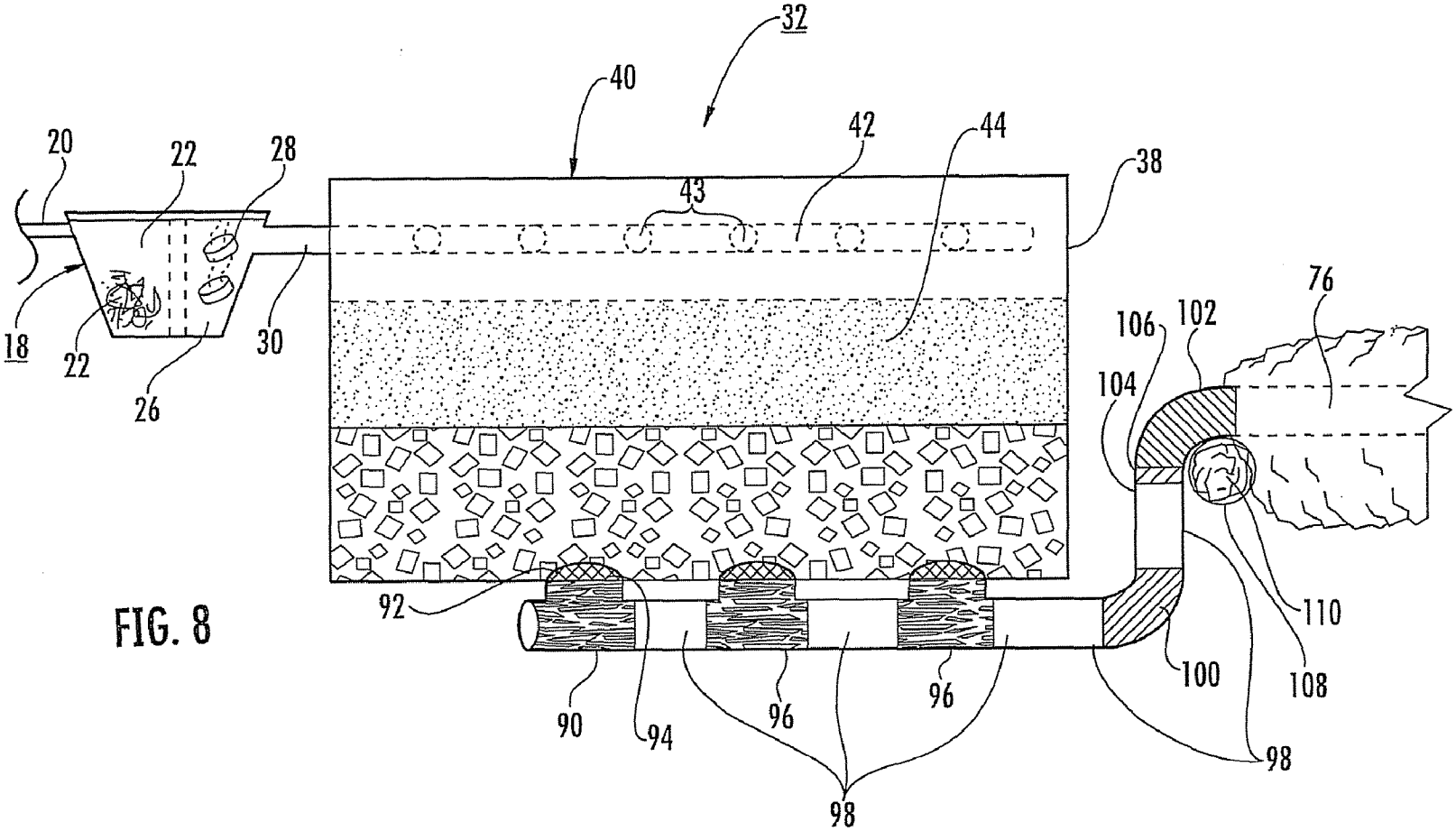

Such an arrangement is shown in FIG. 8 and described next.

There are three main components in the embodiment of FIG. 8: (i) a ninety-degree initial member 90 that includes a portal 92 having a grate 94 on the top of the initial member 90; (ii) tee shaped secondary members 96 that includes a portal 98 on the top of that member, and portions of HDPE corrugated tubing 98 to connect between these members. Located at the distal end of this multi-component drainage unit is a generally "S" shaped fixture that includes a first ninety-degree "S" portion 100 and a second ninety-degree "S" portion 102. Between these two portions is a portion of HDPE corrugated tubing 104. Positioned before the second ninety-degree "S" portion is a final screen 106 to shield any excess particulates, suspensions, or escaped filter media from entering the drainfield reserve 76. The connections between these multi-component parts, the MRFU 32, and the reservoir retention chamber 76 should be generally watertight.

Also shown in FIG. 8 is an additional component to the drainfield reserve 76 known as a trough 108 which is an additional tubular mesh bag filled with variable sized polystyrene beads 110 and is positioned just below the reservoir retention chamber 76 at the point where the end of the second ninety-degree "S" portion connects with the beginning of the reservoir retention chamber 76. The trough 108 assists in distributing post-filtered discharge across the width of the drainfield reserve, as well as prove a buffer or barrier to prevent post-filtered discharge to exist the system mainly at the initial portion of the reservoir retention chamber 76.

From the description of the underground disposal system set forth above, one of ordinary skill can easily envision several methods for using this apparatus for filtering, treating, distributing and cleansing effluent for introduction into the ground soil.

The invention claimed is:

1. An underground disposal system for filtering post-septic effluent comprising:

a watertight basin adapted to be installed underground, the basin having a top, a bottom and connected side walls;

a filter media housed within the basin;

an effluent distribution means within the basin for distributing post-septic effluent through the filter media;

a conduit connecting a septic tank with the basin for transport of post-septic effluent into the distribution means;

a discharge pipe connected underneath and along a substantial portion of the bottom of the basin for receiving and transporting filtered effluent from the basin; and at least one reservoir retention chamber connected with the discharge pipe and laterally separated from the basin, the at least one reservoir retention chamber forming a drainfield reserve for introduction of the filtered effluent into the surrounding soil;

wherein the at least one reservoir retention chamber includes an elongated mesh tube filled with a reservoir retention chamber filter media.

2. The system for filtering post-septic effluent recited in claim 1 further comprising:

at least one opening through the substantial portion of the bottom of the basin;

at least one opening in the discharge pipe corresponding to and positioned generally vertically underneath the at least one opening in the bottom of the basin; and means for joining the discharge pipe with the bottom of the basin so that the at least one discharge pipe opening is in fluid communication with the at least one basin opening.

3. The system for filtering post-septic effluent recited in claim 2 wherein:

the at least one basin opening comprises elongated slot means along the substantial portion of the bottom of the basin; and the at least one discharge pipe opening comprises elongated slot means along a portion of the discharge pipe facing the basin bottom, the elongated discharge pipe slot means aligned and in fluid communication with the elongated slot means along the basin bottom.

4. The system for filtering post-septic effluent recited in claim 3 further comprising a grate fitted in one of the elongated slot means.

5. The system for filtering post-septic effluent recited in claim 3 further comprising a culvert between the bottom of the basin and the top of the discharge pipe for receiving effluent flowing from the basin to the discharge pipe.

6. The system for filtering post-septic effluent as recited in claim 3 wherein the discharge pipe is fitted to the bottom of the basin with a watertight seal.

7. The system for filtering post-septic effluent recited in claim 2 further comprising:

the at least one basin opening comprises multiple discrete openings through the basin bottom along the substantial portion thereof;

the at least one discharge pipe opening comprises multiple discrete openings through the discharge pipe, each discharge pipe opening positioned generally vertically underneath a corresponding one of the discrete openings in the basin bottom; and vertical conduit between each discharge pipe opening and the corresponding opening in basin bottom.

8. The system for filtering post-septic effluent recited in claim 7 wherein the discharge pipe further comprises:

multiple tee-shaped modular members each having a lateral portal each fitted to one of the basin openings, and each modular member having a longitudinal portion with opposing open ends; and discrete intermediate tubing members each coupled to an open end of each modular member.

9. The system for filtering post-septic effluent recited in claim 1, wherein at least a portion of the discharge pipe downstream of the basin is located on a level above the bottom of the basin.

10. The system for filtering post-septic effluent recited in claim 1, wherein the reservoir retention chamber filter media includes expanded polystyrene.

11. The system for filtering post-septic effluent recited in claim 1, further comprising a distribution/filtration box connected to the conduit between the septic tank and the basin.

12. The system for filtering post-septic effluent recited in claim 11, wherein the distribution/filtration box includes a pre-filtration chamber, a filter and a post-filtration chamber.

13. The system for filtering post-septic effluent recited in claim 12, further comprising chlorinated tablets disposed within the post-filtration chamber.

14. The system for filtering post-septic effluent recited in claim 1, wherein the filter media includes expanded polystyrene beads having a diameter of less than or equal to approximately one-eighth inch.

15. An underground disposal system for filtering post-septic effluent comprising:

a watertight basin adapted to be installed underground, the basin having a top, a bottom and connected side walls;

a filter media housed within the basin;

an effluent distribution means within the basin for distributing post-septic effluent through the filter media;

a first conduit connecting a septic tank with the basin for transport of post-septic effluent into the distribution means;

a second conduit connected underneath the basin for receiving and transporting filtered effluent from the basin, the second conduit including a first portion extending out from underneath the bottom of the basin and a second portion downstream from the first portion arranged on a level higher than the bottom of the basin; and at least one reservoir retention chamber connected with the second conduit and laterally separated from the basin, the at least one reservoir retention chamber forming a drainfield reserve for introduction of the filtered effluent into the surrounding soil;

wherein the at least one reservoir retention chamber includes an elongated mesh tube filled with a reservoir retention chamber filter media.

16. The system for filtering post-septic effluent recited in claim 15, wherein the level of the portion of the second conduit is lower than the first conduit.

17. The system of claim 15, wherein the first and second portions of the second conduit are connected by an "S" shaped unit.

* * * * *